US007434292B2

(12) United States Patent
Ramirez Moreno

(10) Patent No.: US 7,434,292 B2
(45) Date of Patent: Oct. 14, 2008

(54) AUTOMATIC ROLLER WRINGER

(75) Inventor: Jose Damian Ramirez Moreno, Cadiz (ES)

(73) Assignee: Sprimsol Limpiezas, S.L., Cadiz (ES)

( * ) Notice: Subject to any disclaimer, the term of this patent is extended or adjusted under 35 U.S.C. 154(b) by 0 days.

(21) Appl. No.: 11/864,818

(22) Filed: Sep. 28, 2007

(65) Prior Publication Data

US 2008/0016645 A1 Jan. 24, 2008

Related U.S. Application Data

(63) Continuation-in-part of application No. 10/758,526, filed on Jan. 16, 2004, now abandoned.

(30) Foreign Application Priority Data

Jan. 16, 2003 (ES) ..... 200300104

(51) Int. Cl.
*A47L 13/60* (2006.01)

(52) U.S. Cl. ..... 15/262; 68/244; 68/269 R; 100/160; 100/176

(58) Field of Classification Search ..... 15/3, 15/262; 68/244, 245, 264, 269 R; 100/160, 100/168, 176
See application file for complete search history.

(56) References Cited

U.S. PATENT DOCUMENTS 1,803,297 A * 4/1931 Schneider ..... 15/262
2,615,191 A * 10/1952 Brown ..... 15/262
3,987,513 A * 10/1976 Gonzales ..... 15/262
4,344,201 A * 8/1982 Trisolini ..... 15/3
4,554,806 A * 11/1985 Hewins ..... 68/257
4,722,113 A * 2/1988 Olsson ..... 15/264
4,928,505 A * 5/1990 Parks et al. ..... 68/253 R
5,245,724 A * 9/1993 Sacks ..... 15/3
5,916,276 A * 6/1999 Walker, Jr. ..... 68/247

FOREIGN PATENT DOCUMENTS

EP 468158 * 9/1993
EP 609187 * 8/1994
EP 614644 * 9/1997
FR 2187266 * 1/1974
FR 2672791 * 8/1992
JP 10-155715 * 6/1998

* cited by examiner

*Primary Examiner*—Mark Spisich
(74) *Attorney, Agent, or Firm*—Michael J. Buchenhorner

(57) ABSTRACT

An automatic roller wringer for mops and the like, consisting of the incorporation of the main gears inside the casing, one of the gears being provided with a projection for the stop, the main gears being asymmetrically assembled on either side, engaging with the fixed roller, each one of the main gears being provided with an eccentric guide on the inner part through which the pivots of the movable roller pass until the latter is in a position adjacent to the fixed roller, which upwardly rotates, the arms supporting the pivots of the arm of the movable roller being provided with a spring on each one.

22 Claims, 5 Drawing Sheets

AUTOMATIC ROLLER WRINGER

CROSS-REFERENCE TO RELATED APPLICATIONS

This application is a continuation-in-part of U.S. application Ser. No. 10/758,526, filed Jan. 16, 2004, now abandoned.

STATEMENT REGARDING FEDERALLY SPONSORED-RESEARCH OR DEVELOPMENT

None.

INCORPORATION BY REFERENCE OF MATERIAL SUBMITTED ON A COMPACT DISC

None.

FIELD OF THE INVENTION

This invention is applicable within the industry dedicated to the manufacture of domestic and industrial cleaning apparatuses, especially within the industry dedicated to the manufacture of automatic wringers or similar devices.

BACKGROUND OF THE INVENTION

The applicant knows of the existence of several devices or elements applicable as wringers which are provided with mechanical actuation elements, operated by the user or users of these elements, configured from clamps, rollers or coupling elements which, directly operated by the user by means of a crank or other actuator, achieve removing water contained by the mop.

The applicant likewise knows of the current existence of a plurality of supports having a similar application, provided with mops or the like whose wringing operation is manually performed by introducing the end of the handle of the floor scrubbing device or the like into frusto-conical shaped inverted baskets which, by means of twisting movements, remove the liquid contained in the mop.

The applicant knows of the current existence of some carts incorporating the body of a recipient on their structure, on which recipient an electric-power supplied wringer is assembled, the feed of which originates from a battery or an accumulator, the body of the wringer being placed on the surface of the recipient bucket, which in turn is provided with a second compartment with clean water, falling to the inside of the compartment adjacent to the clean water container, which may or may not contain a cleaning product, a second compartment on the inside of which the water from the wringing operation slowly falls into.

It must be indicated that these wringing elements are provided with two blades located in opposing points which, when the drive motor thereof is actuated, generate a transportation movement in a coinciding direction, generating the wringing of the mop or the like previously placed between the two movable parts, a movement which automatically stops when the parts generating the mobilization of both wringing areas has carried out its cycle, returning to the standstill position, i.e. separating from one another and allowing the removal of the mop or butt of the handle through the upper part.

It has been shown that these parts which move like blades or the like, generating an approaching movement, do not definitively wring the mop or the like, as a result of which the user must actuate them on several occasions, on one hand leading to a loss of time, as well as a large use of electric power accumulated in the battery.

In view of this drawback, it would be necessary to provide an automatic wringer with incorporated internal transversally arranged rollers in replacement of the blades, rollers which, provided with rotating capacity as well as movement, suitably achieve removing the water existing in the mop or the like.

However, the applicant does not know of the current existence of an invention provided with the features indicated above as suitable.

DESCRIPTION OF THE INVENTION

The present specification refers to an automatic roller wringer for mops and similar devices such as floor scrubbing devices, butts of the handle, and so on; the purpose of which is to facilitate the significant reduction of the effort made by those persons who perform the job of wringing the mop for cleaning floors, or of any similar element, automatically performing the wringing of the mop or the like located on the lower part of the mop handle.

The automatic roller wringer for mops and the like proposed by the invention is a novelty element itself, providing within its context all those features defined as solutions to the evident drawbacks in this matter.

More specifically, the automatic roller wringer for mops and the like object of the invention is constituted of a heavy-duty bucket provided with wheels which facilitate transporting it, on which bucket the automatic roller wringer for mops and the like is supported, internally incorporating different mechanisms which achieve that it acts automatically, without needing to have an external power source.

On the inside of the casing forming the wringer, one or two motors has been provided which are fed by an electric battery arranged inside the casing, which battery is fed until it is saturated by means of the use of a conventional battery charger which is connected to the electric system by one of its ends, and the other one of the ends existing in the charger is incorporated to a base located in the rear part of the casing constituting the wringer, thereby feeding the battery and performing the relevant charging with this operation.

A main switch which starts up the operation or stops the actuation of the wringer has been provided on the outer area of the structure of the wringer, which switch is provided with an automatic thermal protection element.

A projection is provided on the side area of the front face of the wringer, on which projection a switch is incorporated which is operated by the mop handle when it is placed along it in a downward direction, the actuation of this switch generating the start-up of the entire mechanism, achieving that one of the rollers begins rotating and the opposite roller moves while it is rotating until it is adjacent to the fixed rotating roller, which, with the pressure generated between both rollers, leads to the complete wringing of the mop.

DESCRIPTION OF THE DRAWINGS

To complement the description that is being made and for the purpose to aid a better understanding of the features of the invention, two sheets of drawings are attached to the present specification as an integral part thereof which, with an illustrative and non-limiting character, show the following.

PREFERRED EMBODIMENT OF THE INVENTION

Figure 1:
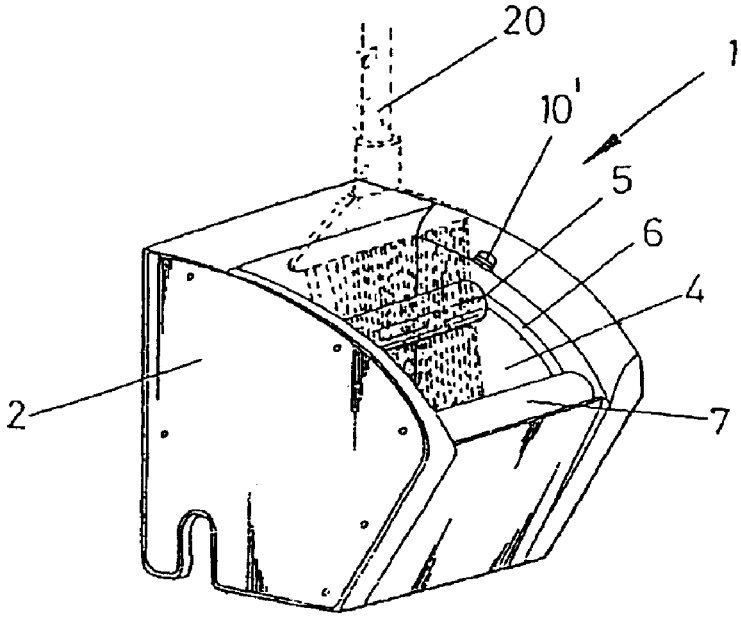
FIG. 1 shows a perspective view from the front, upper area of the invention regarding an automatic roller wringer for mops.

Referring now in specific detail to the drawings, and particularly FIG. 1, there is illustrated a front view of the automatic roller wringer for an apparatus such as a mop consists of: a casing (2), there being arranged on the lower part thereof coupling elements for arranging on a support bucket, and the front central area thereof being completely hollow, except for the existence of two transversal rollers (5) and (7), roller (5) being fixed but provided with rotational movement, whereas roller (7) is movable, shifting on two side guides (6) arranged on the inner area (4) of the casing (2), the movable roller (7) being operated and started up by means of the user's direct actuation with the end of the handle (20) of the mop or the like on an external switch (10') existing in a groove or suitable area on the right side of the upper part of the casing (2).

The movement of the rollers (5) and (7) is performed due to the existence of one or two main gears (12) provided with an eccentric guide on the inner part, through which guide the pivots of the movable arm pass which make the roller (7) advance and press against the mop at the same time that the roller (5) is rotating in a upward direction, a rotation carried out for a predetermined time applicable for carrying out the entire run of the length of the mop or the like, pushing the totally wrung mop (20) out through the upper part, the roller (7) returning to its original position once the wringing has concluded.

The arms supporting the roller (7) are provided with the relevant springs, which results in a certain resilience of the roller (7), since it permits the latter to adapt to the different types and thicknesses of mops, butts of handles, floor scrubbing devices, and the like.

Figure 2:
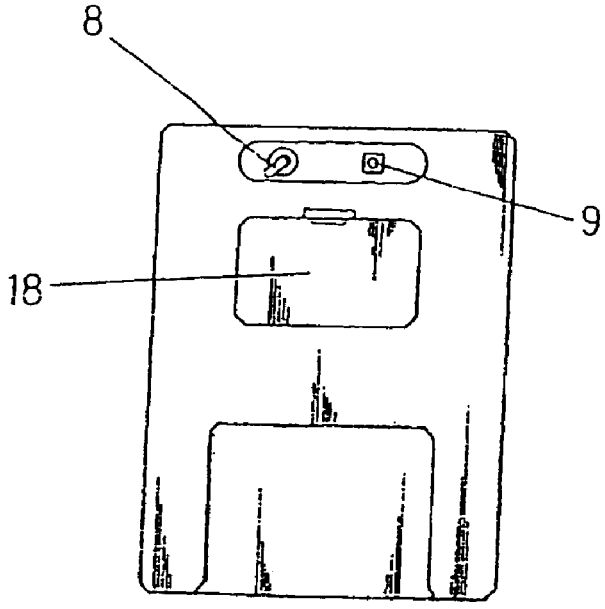
FIG. 2 shows a rear elevation view of the object shown in FIG. 1.

Referring to FIG. 2 there is shown a rear view according to an embodiment of the invention. The start-up is carried out by means of the main external switch (8), but the movement is carried out by letting the mop (20) fall into the gap existing in the upper right-hand area, generating the mobilization of the push button or switch (10'), making the motor (15) rotate the time which is necessary until the micro (11) is actuated, and accordingly feeding the circuit during the entire run, the stop being carried out by means of a projection (13) existing on the main gears (12) which actuate the micro (11), it being necessary to indicate that the entire wringing process is carried out in a single rotation of said main gears (12), the circuit being open and prepared for a subsequent wringing or actuation.

Figure 3:
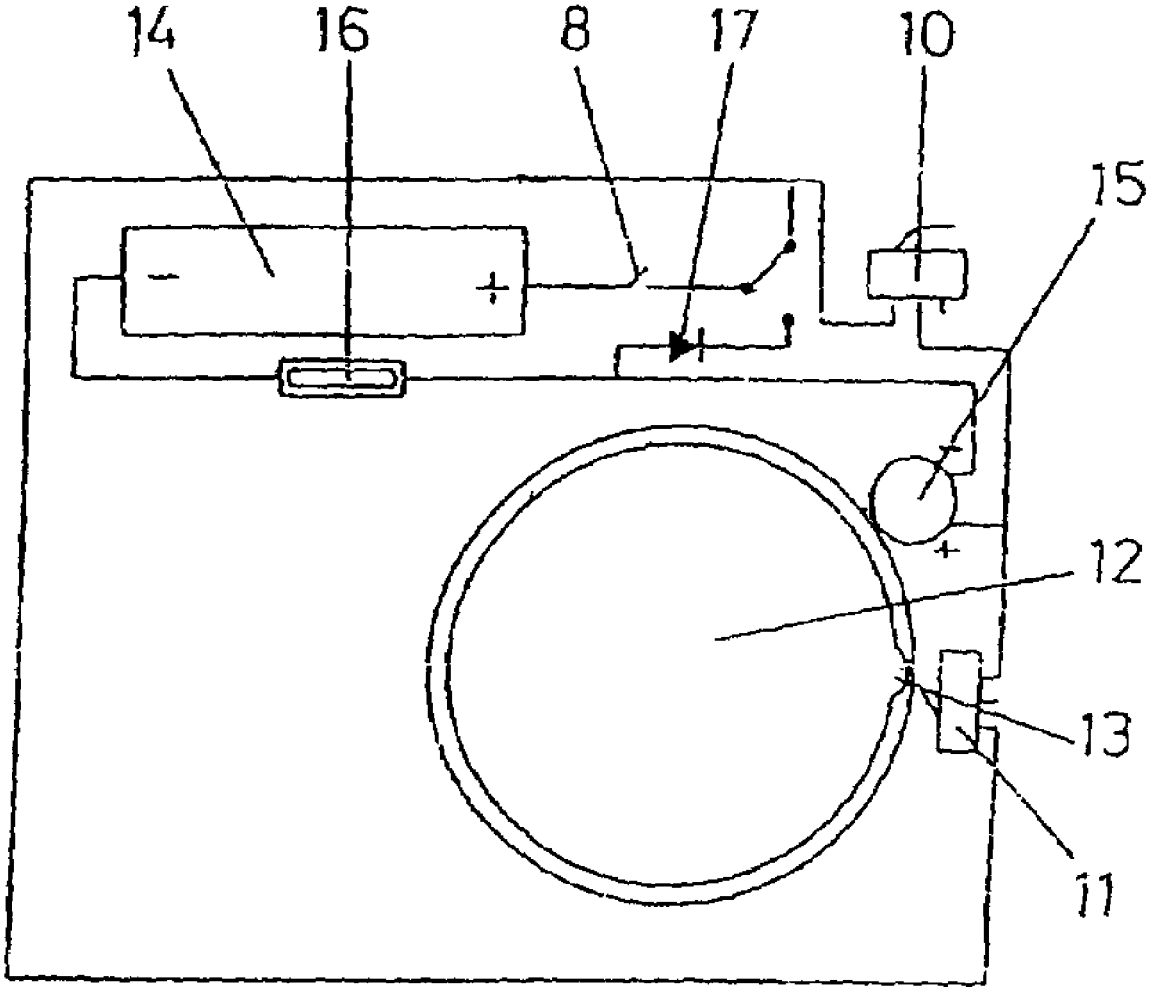
FIG. 3 shows a block diagram of the elements incorporated on the inside of the object of the invention, shown in FIGS. 1 and 2.

Referring now to FIG. 3 there is shown a block diagram of the elements incorporated on the inside of the object of the invention. The automatic wringer (1) is provided on its rear part with a main switch (8), as well as a charging connection (9) for charging the battery, the circuit being open during the charge time, a circuit which is provided with a polarizing diode (17) as a security means, as well as a thermal element (16) serving as protection for the entire electric circuit.

The battery has been referenced with (14), and the internal push button with (10), which push button acts in collaboration with external push button (10'), making the motor rotate.

An access door (18) constituting the cover of the battery has been provided on the rear part.

Figure 4:
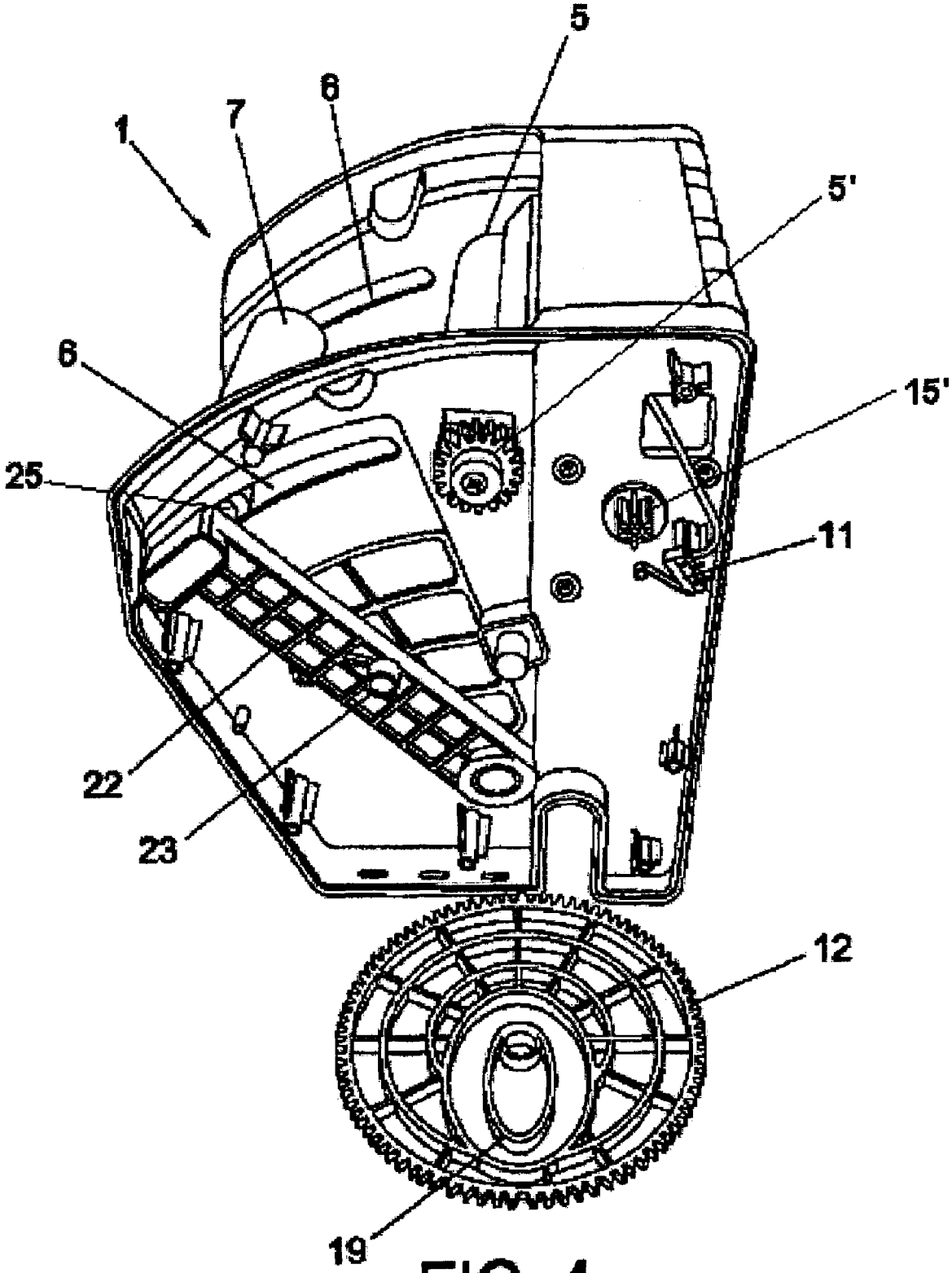
FIG. 4 shows a perspective view of the automatic roller wringer automatic roller of FIG. 1 having the exterior panel of the casing removed and the main gear inverted to show an eccentric guide.

Referring to FIG. 4, the movement of the rollers (5) and (7) is performed due to the existence of one or two main gears (12) provided with an eccentric guide (19) on the inner part, through which guide the pivots (23) of the movable arm (22) pass which make the roller (7) advance and press against the mop at the same time that the roller (5) is rotating in an upward direction, a rotation carried out for a predetermined time applicable for carrying out the entire run of the length of the mop or other apparatus, pushing the totally wrung mop (20) out through the upper part, the roller (7) returning to its original position once the wringing has concluded. A movement of roller (7) is guided in part by lugs (25), which are disposed in the side guides (6), that couple the roller (7) to movable arms (22) on either side, at least one of which is driven by a main gear (12).

Figure 5:
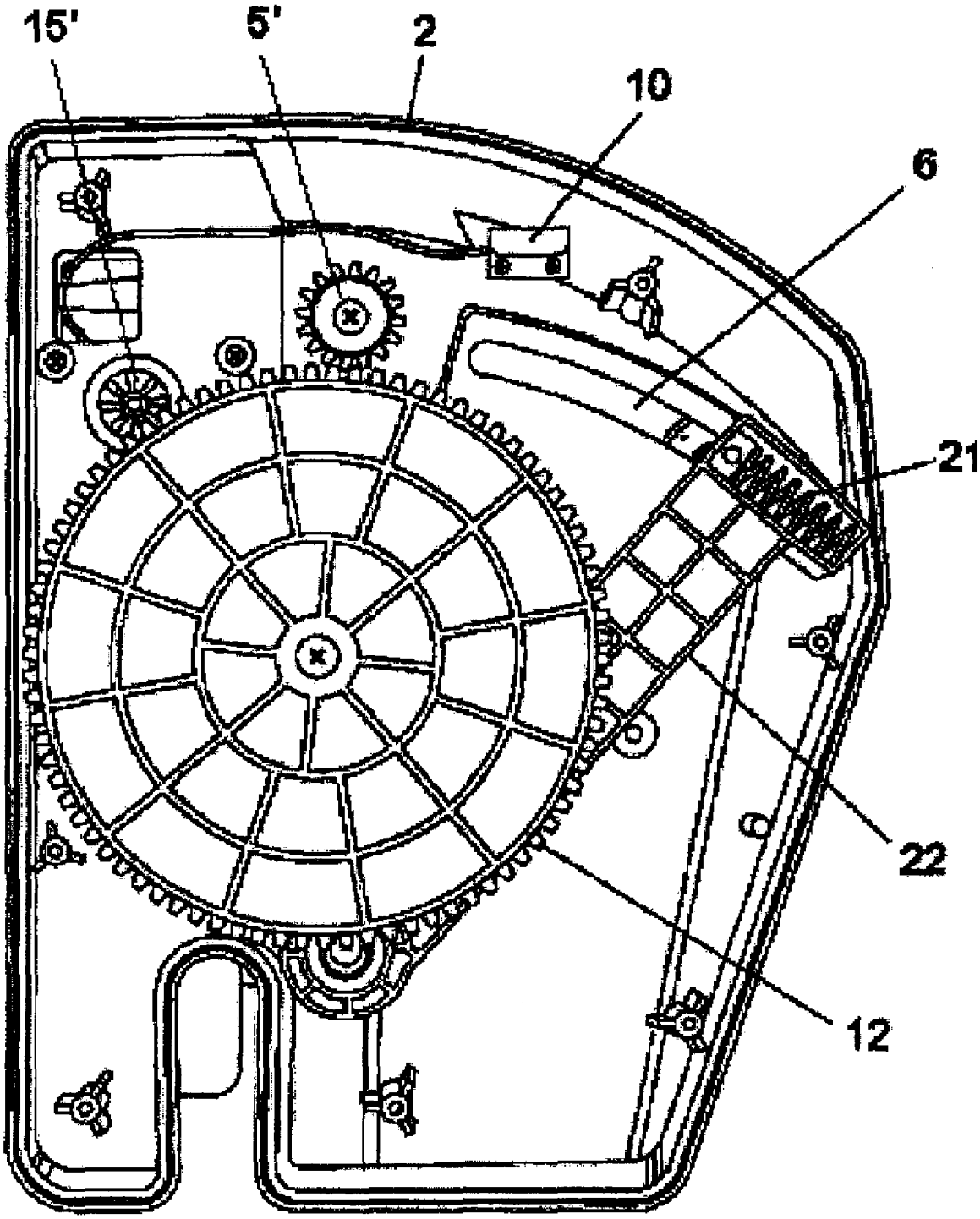
FIG. 5 shows a side elevation view of the interior of the casing of the automatic roller wringer of FIG. 1.

Looking at FIG. 5, the arms (22) supporting the roller (7) are provided with the relevant springs (21), which results in a certain resilience of the roller (7), since it permits the latter to adapt to the different types and thicknesses of mops, butts of handles, floor scrubbing devices, etc. In addition, the main gear (12), which is driven by drive gear (15') engages a driven gear (5') to provide rotation of the fixed roller (5).

Referring to FIGS. 1-3, the start-up is carried out by means of the main external switch (8) on the rear of the automatic wringer (1), but the movement is carried out by letting the mop (20) fall into the gap existing in the upper right-hand area, generating the mobilization of the push button or switch (10'), making the motor (15) rotate the time which is necessary until the microswitch (11) is actuated, and accordingly feeding the circuit during the entire run, the stop being carried out by means of a projection (13) existing on the main gears (12). Looking at FIG. 4, the motor (15) comprises a drive gear (15') that engages the main gear (12) to provide rotation during a wringing operation.

Figure 6:
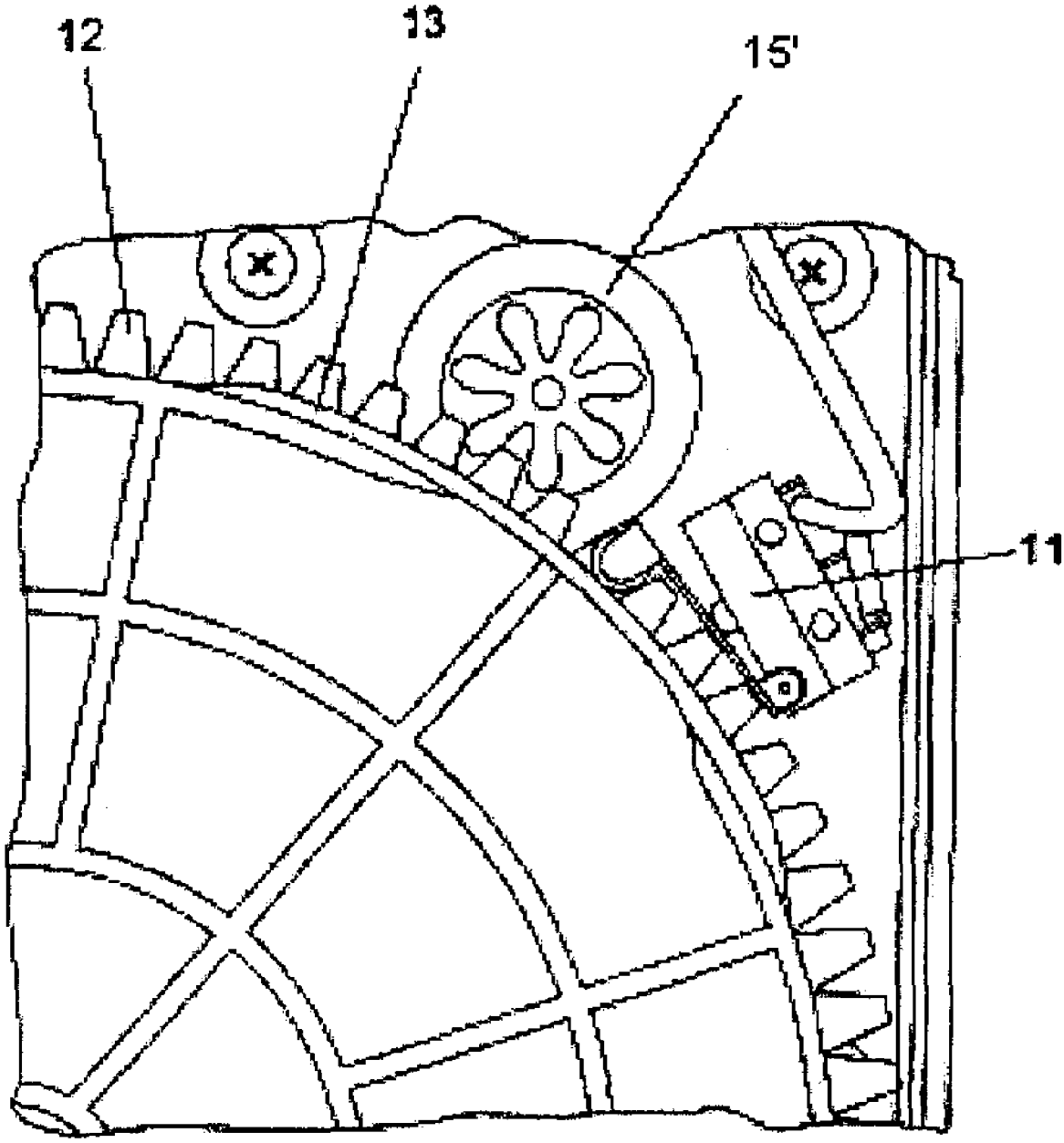
FIG. 6 shows a close-up elevation view of a projection of the main gear engaging the microswitch.

Referring to FIG. 6, an area of the main gear (12) comprising the projection (13) actuates the microswitch (11), it being necessary to indicate that the entire wringing process is carried out in a single rotation of said main gears (12), the circuit being open and prepared for a subsequent wringing or actuation.

The invention claimed is:

1. An automatic roller wringer for a mop, the automatic roller wringer comprising:

an external casing comprising: a front, central hollow area, configured for being adapted on a bucket; and a rear area of the external casing on which is disposed a switch and a charging connection for connecting a battery charger;

at least one motor configured to drive a plurality of gears incorporated inside the external casing, the at least one motor being fed from a circuit comprising at least one battery or accumulator accessible by an access door on the rear area of the external casing;

two asymmetrical arms on each side of the hollow area operatively coupled to the at least one motor by the plurality of gears; and first and second transversal rollers arranged in the hollow area, the second transversal roller coupled to the asymmetrical arms and shifting until coinciding with the first transversal roller by means of two projecting lugs connected to the arms, the lugs resting on two parallel guides arranged on opposing inner faces on either side of the hollow area, the first transversal roller rotating but remaining fixed at a point in which it is located relative to the parallel guides.

2. The automatic roller wringer of claim 1, wherein the plurality of gears comprises:

two main gears asymmetrically assembled on each side of the hollow area, engaging with the first roller, the main gears configured with an eccentric guide on the lower part of each one of them through which a pivot disposed on each of the movable arms pass, which arms generate the advance and pressure of the second roller on the mop and on the fixed, first roller which upwardly rotates along the entire length of the mop, the second roller returning to its standstill position.

3. The automatic roller wringer of claim 2, wherein a part of the arms which support the second transversal roller are provided with a spring on each one of the arms, starting up by a main switch, in collaboration with an external actuator generating the start up of an internal actuator, the motor maintaining rotation until a microswitch determines the stop of the motor and carries out the feeding of the circuit in the entire run.

4. The automatic roller wringer of claim 3, wherein one of the main gears is provided with a projection which operates the microswitch configured to switch off the motor.

5. The automatic roller wringer of claim 3, wherein a wringing process is generated with a single rotation of the main gears, the circuit thereby being open.

6. The automatic roller wringer of claim 3, wherein the battery is electrically coupled to a polarizing diode and a thermal element.

7. The automatic roller wringer of claim 1, wherein a part of the arms which support the second transversal roller are provided with a spring on each one of the arms, starting up by a main switch, in collaboration with an external actuator generating the start up of an internal actuator, the motor maintaining rotation until a microswitch determines the stop of the motor and carries out the feeding of the circuit in the entire run.

8. The automatic roller wringer of claim 7, wherein one of the plurality of gears is provided with a projection which operates the microswitch.

9. The automatic roller wringer of claim 7, wherein the plurality of gears comprises two main gears on opposing sides of the hollow area and a wringing process is generated with a single rotation of the main gears, the circuit thereby being open.

10. The automatic roller wringer of claim 7, wherein the circuit comprises a polarizing diode and a thermal element.

11. The automatic roller wringer of claim 1, wherein one of the plurality of gears is provided with a projection which operates a microswitch configured to switch off the motor.

12. The automatic roller wringer of claim 11, wherein the plurality of gears comprises two main gears on opposing sides of the hollow area and a wringing process is generated with a single rotation of the main gears, the circuit thereby being open.

13. The automatic roller wringer of claim 11, wherein the circuit comprises a polarizing diode and a thermal element.

14. The automatic roller wringer of claim 1, wherein the plurality of gears comprise two main gears on opposing sides of the hollow area and a wringing process is generated with a single rotation of the main gears, the circuit thereby being open.

15. The automatic roller wringer of claim 1, wherein the circuit comprises a polarizing diode and a thermal element.

16. The automatic roller wringer of claim 2, wherein one of the main gears is provided with a projection which operates a microswitch configured to switch off the motor.

17. The automatic roller wringer of claim 16, wherein a wringing process is generated with a single rotation of the main gears, the circuit thereby being open.

18. The automatic roller wringer of claim 16, wherein the circuit comprises a polarizing diode and a thermal element.

19. An automatic roller wringer comprising:

an external casing, which is provided with a front, central hollow area and which is adapted to be received on an edged support;

at least one motor mounted within said casing;

a first roller and a second roller, wherein one of said rollers is movable and the other of said rollers is fixed, with respect to said casing;

a pair of asymmetrical arms mounted on opposite sides of said movable roller and further comprising projecting pivots, wherein a pair of pressuring springs are fitted into a pair of cavities, each of said cavities being formed within one of said arms; and a pair of main gears, asymmetrically mounted on opposite sides of said cavity, each of said gears comprising an eccentric guide formed on a lower portion of said gear, such that said guides receive said pivots and said gears engage said movable roller, whereby said gears are operatively connected to said movable roller and whereby said gears advance said movable roller toward said fixed roller.

20. The automatic roller wringer of claim 19, wherein said at least one motor is an electric motor and said at least one motor is adapted to be powered by a battery or accumulator.

21. The automatic roller wringer of claim 19, wherein one of said main gears further comprises a projection which engages a microswitch to switch on and to switch off said at least one motor.

22. The automatic roller wringer of claim 19, wherein said main gears are adapted such that said movable roller reaches said fixed roller by a single rotation of said main gears.

* * * * *